United States Patent [19]

Tsai

[11] 4,158,638

[45] Jun. 19, 1979

[54] RECOVERY OF OIL FROM OIL SHALE

[75] Inventor: Shirley C. Tsai, Pittsburgh, Pa.

[73] Assignee: Gulf Research & Development Company, Pittsburgh, Pa.

[21] Appl. No.: 890,073

[22] Filed: Mar. 27, 1978

[51] Int. Cl.[2] ..... C10G 1/00; E21B 43/24

[52] U.S. Cl. ..... 208/11 LE; 208/11 R; 166/272

[58] Field of Search ..... 166/272; 208/11 LE, 208/11 R

[56] References Cited

U.S. PATENT DOCUMENTS

| | | | |
|---|---|---|---|
| 2,601,257 | 6/1952 | Buchan | 208/11 LE |
| 2,862,558 | 12/1958 | Dixon | 166/272 |
| 2,974,937 | 3/1961 | Kiel | 166/272 X |
| 3,051,644 | 8/1962 | Friedman et al. | 208/11 R |
| 3,567,622 | 3/1971 | Waltrip | 208/11 R |
| 3,768,558 | 10/1973 | Allen et al. | 166/272 |
| 3,838,738 | 10/1974 | Redford et al. | 166/272 X |
| 3,881,550 | 5/1975 | Barry | 166/272 |
| 4,068,716 | 1/1978 | Allen | 166/272 X |

FOREIGN PATENT DOCUMENTS

| | | | |
|---|---|---|---|
| 1016862 | 9/1977 | Canada | 166/272 |
| 1112956 | 5/1968 | United Kingdom | 166/272 |

*Primary Examiner*—Delbert E. Gantz
*Assistant Examiner*—William G. Wright

[57] ABSTRACT

A process for recovering oil from oil shale containing kerogen which comprises contacting said oil shale at a reaction temperature of at least about 300° C. with steam having a partial pressure of at least about 450 psia (3.1 MPa) and an organic solvent having a boiling point at ambient pressure, that is, about 15 psia (0.1 MPa), of at least about 80° C.

23 Claims, No Drawings

RECOVERY OF OIL FROM OIL SHALE

BACKGROUND OF THE INVENTION

1. Field of the Invention

This invention relates to a new and useful process for recovering oil from oil shale containing kerogen, a solid organic, primarily hydrocarbon, material having a high molecular weight, i.e., greater than about 3,000 grams/-mole, which comprises about 10 to about 30 percent by weight of oil shale. The percentage recovery, as oil, of the organic matter originally present in the oil shale is low by most methods known in the art. Even the best operations result in relative high conversion of kerogen to carbon and permanent gases, which are of low economic value compared to liquid fuels. Consequently, a need exists for a simple process for recovering oil from oil shale which results in high yields of liquid product. Accordingly, the present invention provides a higher yield of liquid product by a process for recovering oil from oil shale containing kerogen which comprises contacting said oil shale at a reaction temperature of at least about 300° C. with steam having a partial pressure of at least about 450 psia (3.1 MPa) and an organic solvent having a boiling point at ambient pressure, that is, about 15 psia (0.1 MPa), of at least about 80° C.

2. Description of the Prior Art

U.S. Pat. No. 3,051,644 to L. D. Friedman teaches the recovery of oil from oil shale utilizing high pressure and high temperature steam. There is no mention of the use of a solvent and the pressure used is greater than that required herein (column 1, lines 12 to 17).

U.S. Pat. No. 2,601,257 to F. E. Buchan recovers oil from oil shale using a heavy hydrocarbon oil in the absence of steam and at lower pressures than required herein (column 5, lines 61 and 62).

U.S. Pat. No. 3,567,622 to O. R. Waltrip teaches the co-use of steam and hydrocarbon vapor at atmospheric pressure.

Furthermore, the kerogen conversions or the oil yields obtained in the prior art differ substantially from the results obtained by using the present invention herein. The kerogen conversions in the prior art are low. Specifically, the kerogen conversions for Buchan, Friedman, and Waltrip teachings are 61%, 65% and 55% respectively, in all cases less than 80%. However, in one embodiment of the present invention the yield is nearly 90%.

SUMMARY OF THE INVENTION

I have discovered a novel process for recovering oil from oil shale containing kerogen which comprises contacting said oil shale at a reaction temperature of at least about 300° C. with steam having a partial pressure of at least about 450 psia and an organic solvent having a boiling point at ambient pressure of at least about 80° C.

DETAILED DESCRIPTION OF THE PROCESS

Any oil shale containing kerogen can be used in the invention herein. Generally, the shale is pulverized. For example, the shale can have a mesh size of at least about 10 but not in excess of about 400 using a U.S. Standard sieve, preferably at least about 20 but not in excess of about 200. The shale used in the examples herein came from shale deposits in the Western States of the United States, especially the States of Colorado and Wyoming. It is often referred to as Green River oil shale, and a description of its typical composition is reported by Stanfield, K. E., Frost, I. C., McAuley, W. S. and Smith, H. N. in Bureau of Mines Report of Investigations number 4825, 1951 entitled "Properties of Colorado Oil Shales", and also by Smith, John Ward in Bureau of Mines Report of Investigations number 5725, 1961 entitled "Ultimate Composition of Organic Material in Green River Oil Shale". However, this process is also applicable to oil shales from other areas, such as Chattanooga shale from Tennessee.

Any organic solvent, or a mixture of solvents in which the product oil is soluble, can be employed in the present invention. Preferably, any organic solvent or a mixture of organic solvents, which is a liquid under reaction conditions, most preferably a hydrocarbon solvent or a mixture of hydrocarbon solvents, which is a liquid under reaction conditions can be employed herein. The boiling point at ambient pressure of the solvent is at least about 80° C., preferably at least about 200° C., and is no higher than about 500° C., preferably no higher than about 450° C. Examples of organic solvents can include aromatics, such as benzene, 3-methylnaphthalene, phenol, quinone and quinoline; hydroaromatics, such as tetralin, hydrophenanthrenes and hydroanthracenes; aliphatics, such as hexane, cyclohexane, decane, cetane and decalin; alcohols, such as isopropanol and ethylene glycol; ketones, such as methyl ethyl ketone; and mixtures of organic compounds, such as product oil, shale oil, anthracene oil, diesel oil and coal liquids.

The mixture of oil shale and solvent is contacted with steam having a partial pressure of steam of at least about 450 psia (3.1 MPa), preferably at least about 550 psia (3.8 MPa). The upper limit of the partial pressure of the steam is determined by the economics of operation, but, in no case does it appear necessary to go above about 2500 psia (17.2 MPa), preferably it is not necessary to go above about 2000 psia (13.8 MPa). The partial pressure of steam was determined as the difference between the total pressure in the reactor and pressure of all of the components therein other than steam.

The total pressure for the process of the present invention depends on the volatility of the solvent. In general, the total pressure is at least about 500 psia (3.5 MPa), preferably at least about 600 psia (4.2 MPa) but no higher than about 3000 psia (20.8 MPa), preferably no higher than about 2500 psia (17.2 MPa).

A solvent to shale volume/weight ratio (v/w) of at least about 0.1:1, preferably at least about 0.5:1, is established. The upper limit of the solvent to shale ratio is not critical and is determined by economics of the operation and capability of the equipment but can be, for example, no greater than 4:1, preferably no greater than 2.5:1. A water to shale weight ratio (w/w) can be any ratio sufficient to produce the defined critical partial pressure of steam. For example, the water to shale weight ratio can be at least about 0.1:1, preferably at least about 0.2:1. The upper range of the water to shale weight ratio is determined by the economics of operation, but can be, for example, no greater than about 2:1, preferably no greater than about 1:1. The slurry is mixed or maintained in any suitable manner that will result in a high degree of three-phase dispersion.

Kerogen is rich in hydrogen but easily loses hydrogen at high temperatures. If the temperature of the process is too high, then not only the quantity of liquid product decreases because of cracking but also the product quality deteriorates because the product loses hydrogen. If the temperature of the process is too low, then the rate of reaction is too slow. The temperature of the present invention, therefore, is at least about 300° C., preferably at least about 350° C. but no greater than about 500° C., preferably no greater than 450° C.

Contact time for the process of the present invention depends on the temperature and the type of operation. For example, in batch and continuous operations of above-ground processing, contact time can be at least about 10 minutes, preferably about 30 minutes, but no greater than 12 hours, preferably no greater than 4 hours. In an in-situ operation, contact time is, for example, at least about 1 hour, preferably at least about 2 hours, but no more than 30 days, preferably no more than 15 days.

Separation of the oil including the solvent from the spent shale can be effected in any conventional manner, such as filtration, settling and centrifuging. The oil and solvent mixture is then fractionated with the solvent fraction being recycled.

The process of the present invention can be carried out as a batch or continuous operation for above-ground processing of shale or as an in-situ operation.

For a batch operation, shale, solvent and water are placed in a pressure vessel, such as an autoclave. The pressure vessel is then heated to the reaction temperature and maintained at the reaction temperature for a specified contact time as mentioned previously. At the end of the reaction, the pressure vessel is cooled to room temperature and the gas is collected. Subsequently, the liquid and solid products are discharged and separated by any suitable means. The solid product is washed with solvent to recover residual oil. The total liquid product including the wash is then fractionated with the solvent fraction being reused in the process.

In a continuous operation the feed contains shale and solvent, as a slurry or paste, and water, as liquid water or as steam, is introduced, either initially with said feed or later at one or more points in a reactor of the horizontal or vertical type, with a vertical reactor being preferred. Optionally, the feed and water are preheated to the reaction temperature. The reaction conditions and the product recovery and solvent recycle systems employed in the continuous operation are the same as employed in the batch operation.

Kerogen conversion is the amount of organic carbon removed from the oil shale divided by the total amount of organic carbon contained in the shale sample multiplied by 100. Oil yield is the yield of liquid product in terms of Fischer Assay oil yield. The Fischer Assay oil yield is the yield of oil, in terms of gallons per ton, which is obtained from laboratory-scale retorting at 482° C. The oil yield is determined from the kerogen conversion divided by sixty-five percent.

DESCRIPTION OF PREFERRED EMBODIMENTS

The invention will be further described with reference to the experimental data.

EXAMPLE 1

Fifty grams of pulverized oil shale containing 12.8 weight percent organic carbon, along with 75 milliliters of tetralin and 30 grams of water were charged to a one-liter stirring autoclave. The autoclave was then heated from room temperature, zero gauge pressure to an extraction temperature of 374° C. The corresponding total pressure was 965 psia (6.7 MPa) and the partial pressure of steam was 640 psia (4.4 MPa).

The extraction continued at the temperature of 374° C. and the partial steam pressure of 640 psia for two hours. At the end of extraction the autoclave was cooled to room temperature. Subsequently, the product gases and the solid/liquid products were separated. The latter were then filtered. The filtrate was submitted for distillation and the solvent fraction was reused. Meanwhile, the filter cake was washed with an organic solvent, such as ethyl acetate, for recovery of residual oil. The resulting spent shale weighed 41.6 grams and analyzed 2.3 weight percent organic carbon. The corresponding conversion was found to be 85%. The product gases contained mainly carbon dioxide resulting from decomposition of the inorganic carbonates in the oil shale. The hydrocarbon fraction of the product gases was equivalent to less than 4% kerogen conversion. This example is recorded in Table 1 as Run Number 5. Run Numbers 1 through 4 and 6 through 13 were performed identically except for variations in conditions as set forth in Table I.

TABLE 1

| | Kerogen Conversion | | | | | |
|---|---|---|---|---|---|---|
| Run Number: | 1 | 2 | 3 | 4 | 5 | 6 |
| Materials | | | | | | |
| shale (g) | 50 | 100 | 50 | 100 | 50 | 150 |
| solvent (ml) | 75 | 100 | 75 | 100 | 75 | 150 |
| water (g) | 0 | 10 | 25 | 25 | 30 | 30 |
| solvent/shale v/w ratio | 1.5[a] | 1.0[a] | 1.5[a] | 1.0[a] | 1.5[a] | 1.0[a] |
| water/shale w/w ratio | 0 | 0.1 | 0.5 | 0.25 | 0.60 | 0.2 |
| Reaction Conditions | | | | | | |
| Temperature, °C. | 374 | 374 | 374 | 374 | 374 | 374 |
| Total Pressure, psia (MPa) | 325(2.2) | 565(3.9) | 725(5.0) | 840(5.8) | 965(6.7) | 1040(7.2) |
| Partial Steam Pressure, psia (MPa) | 0(0) | 240(1.7) | 400(2.8) | 515(3.6) | 640(4.4) | 715(4.9) |
| Time, Hr. | 2 | 2 | 2 | 2 | 2 | 1.5 |
| Kerogen Conversion, wt % | 61 | 61 | 59 | 74 | 85 | 89 |
| Oil Yield, % Fischer Assay | 94 | 94 | 91 | 114 | 131 | 137 |

| Run Number: | 7 | 8 | 9 | 10 | 11 | 12 | 13 |
|---|---|---|---|---|---|---|---|
| Materials | | | | | | | |
| shale (g) | 75 | 75 | 100 | 75 | 75 | 100 | 75 |
| solvent (ml) | 50 | 50 | 100 | 50 | 50 | 0 | 30 |
| water (g) | 50 | 75 | 50 | 10 | 50 | 10 | 50 |
| solvent/shale v/w ratio | 0.67[a] | 0.67[a] | 1.0[a] | 0.67[b] | 0.67[b] | 0 | 1.5[a] |
| water/shale w/w ratio | 0.67 | 1.0 | 0.5 | 0.14 | 0.67 | 0.1 | 0.6[c] |

TABLE 1-continued

| Reaction Conditions | Kerogen Conversion | | | | | | |
|---|---|---|---|---|---|---|---|
| Temperature, °C. | 374 | 374 | 374 | 374 | 374 | 374 | 385 |
| Total Pressure, psia (MPa) | 1490(10.3) | 2025(14.0) | 2215(15.3) | 725(5.0) | 1740(12.0) | 265(1.8) | 1000(7.0) |
| Partial Steam Pressure, psia (MPa) | 1165(8.0) | 1700(11.7) | 1890(13.0) | ~240(1.7) | ~1255(8.7) | 250(1.7) | 600(4.1) |
| Time, Hr. | 2 | 2 | 2 | 2 | 2 | 2 | 0.75 |
| Kerogen Conversion, wt % | 85 | 84 | 88 | 65 | 80 | 64 | 85 |
| Oil Yield, % Fischer Assay | 131 | 129 | 135 | 100 | 101 | 98 | 130 |

[a]Tetralin solvent was in a liquid state at reaction conditions.
[b]Benzene solvent was in a gas state at reaction conditions.
[c]A small amount of sodium chloride was added to facilitate the separation of oil and solvent from the spent shale and water.

From Table 1 it can be seen that the kerogen conversion does not change as the partial pressure of steam increases from 0 to 240 and to 400 psia (Run Numbers 1 to 2 to 3, respectively). It can be seen from Run Numbers 4 through 9 that where the partial pressure of steam ranges from 515 to 1890 psia, respectively, particularly from 640 to 1890 psia, unexpectedly high kerogen conversions are obtained. In Run Numbers 10 and 11, employing benzene as the solvent, adequate kerogen conversion is shown to depend on the partial pressure of steam by comparing Run Number 10 having a partial pressure outside the desired range with Run Number 11, having a partial pressure within the desired range. Run Number 12 shows that it is critical that a solvent be present in the process. Run Number 13 shows the effect of temperature on the process of the invention in that the reaction rate is faster at higher temperatures.

Obviously, many modifications and variations of the invention, as hereinabove set forth, can be made without departing from the spirit and scope thereof, and therefore only such limitations should be imposed as are indicated in the appended claims.

I claim:

1. A process for recovering oil from oil shale containing kerogen which comprises contacting said oil shale at a reaction temperature of about 300° C. to about 500° C. with steam having a partial pressure of about 450 to about 2500 psia and an organic solvent having a boiling point at ambient pressure of about 80° to about 500° C.

2. A novel process according to claim 1 wherein said oil shale is pulverized to a mesh size ranging from about 10 to about 400 U.S. Standard sieve.

3. A novel process according to claim 1 wherein said oil shale is pulverized to a mesh size ranging from about 20 to about 200 U.S. Standard sieve.

4. A novel process according to claim 1 wherein said organic solvent is a liquid under reaction conditions.

5. A novel process according to claim 1 wherein said organic solvent is a hydrocarbon solvent or a mixture of hydrocarbon solvents which is a liquid under reaction conditions.

6. A novel process according to claim 1 wherein said organic solvent has a boiling point ranging from about 200° to about 450° C.

7. A novel process according to claim 1 wherein said organic solvent is benzene.

8. A novel process according to claim 1 wherein said organic solvent is tetralin.

9. A novel process according to claim 1 wherein said organic solvent is product oil.

10. A novel process according to claim 1 wherein said partial pressure of steam ranges from about 550 to about 2000 psia.

11. A novel process according to claim 1 wherein total pressure ranges from about 500 to about 3000 psia.

12. A novel process according to claim 1 wherein total pressure ranges from about 600 to about 2500 psia.

13. A novel process according to claim 1 wherein a solvent to shale volume/weight ratio ranges from about 0.1:1 to about 4:1.

14. A novel process according to claim 1 wherein a solvent to shale volume/weight ratio ranges from about 0.5:1 to about 2.5:1.

15. A novel process according to claim 1 wherein a water to shale weight ratio ranges from about 0.1:1 to about 2:1.

16. A novel process according to claim 1 wherein a water to shale weight ratio ranges from about 0.2:1 to about 1:1.

17. A novel process according to claim 1 wherein said temperature ranges from about 350° to about 450° C.

18. A novel process according to claim 1 wherein said process has a contact time ranging from about 10 minutes to about 12 hours in batch and continuous operations.

19. A novel process according to claim 1 wherein said process has a contact time ranging from about 30 minutes to about 4 hours in batch and continuous operations.

20. A novel process according to claim 1 wherein said process has a contact time ranging from about 1 hour to about 30 days in in-situ operation.

21. A novel process according to claim 1 wherein said process has a contact time ranging from about 2 hours to about 15 days in in-situ operation.

22. A novel process according to claim 1 wherein said solvent is tetralin; said partial pressure of steam ranges from about 475 to about 1000 psia; and wherein said process has a total pressure ranging from about 600 to about 2000 psia, a solvent to shale volume weight ratio ranging from about 0.5:1 to about 2.5:1, a water to shale weight ratio ranging from about 0.2:1 to about 1:1 and a temperature ranging from about 350° to about 450° C.

23. A novel process according to claim 1 wherein said solvent is benzene; said partial pressure of steam ranges from about 475 to about 1000 psia; and wherein said process has a total pressure ranging from about 600 to about 2000 psia, a solvent to shale volume weight ratio ranging from about 0.5:1 to about 2.5:1, a water to shale weight ratio ranging from about 0.2:1 to about 1:1 and a temperature ranging from about 350° to about 450° C.

* * * * *